US010639533B2

(12) United States Patent
LoDuca et al.

(10) Patent No.: US 10,639,533 B2
(45) Date of Patent: May 5, 2020

(54) ROBOTIC BATTING TEE SYSTEM HAVING A ROLLABLE NECK

(71) Applicant: Robosport Technologies LLC, Whitestone, NY (US)

(72) Inventors: Salvatore LoDuca, Great Neck, NY (US); John Boucard, Overland Park, KS (US)

(73) Assignee: ROBOSPORT TECHNOLOGIES LLC, Whitestone, NY (US)

( * ) Notice: Subject to any disclaimer, the term of this patent is extended or adjusted under 35 U.S.C. 154(b) by 0 days.

(21) Appl. No.: 15/903,887

(22) Filed: Feb. 23, 2018

(65) Prior Publication Data

US 2019/0262687 A1 Aug. 29, 2019

(51) Int. Cl.

*A63B 71/00* (2006.01)
*A63B 69/00* (2006.01)
*A63B 102/18* (2015.01)

(52) U.S. Cl.

CPC ..... *A63B 69/0075* (2013.01); *A63B 69/0002* (2013.01); *A63B 2069/0008* (2013.01); *A63B 2102/18* (2015.10); *A63B 2102/182* (2015.10)

(58) Field of Classification Search

CPC ..... A63B 69/0075; A63B 69/0002; A63B 2102/18; A63B 2102/182; A63B 2069/0008

USPC ..... 473/417–219, 422, 451, 438, 446; 124/56, 75; D21/720

See application file for complete search history.

(56) References Cited

U.S. PATENT DOCUMENTS 2,040,228 A 5/1936 Whiteley
3,144,104 A * 8/1964 Weir ..... E04C 3/005 182/41
3,318,068 A 5/1967 Johannes
3,387,414 A * 6/1968 Adams ..... E04C 3/005 206/216

(Continued)

FOREIGN PATENT DOCUMENTS

JP S61-187393 6/1988
JP H03-37445 2/1991

(Continued)

OTHER PUBLICATIONS

Notice of Reasons for Refusal dated Jan. 28, 2014, in JP Patent Application No. 2012-216004.

(Continued)

*Primary Examiner* — Mitra Aryanpour
(74) *Attorney, Agent, or Firm* — Akerman LLP

(57) ABSTRACT

According to one example, a batting tee system includes a housing, an arm coupled to the housing, and an actuation system. The actuation system includes a spool, a rollable neck, and an actuator. The rollable neck is configured to be wound around the spool when the spool rotates in a first direction and is further configured to be unwound from the spool when the spool rotates in a second direction. The rollable neck is configured to have a flat form when wound around the spool and is further configured to transition from the flat form to a hollow tube form when unwound from the spool. The actuator is configured to rotate the spool. The actuation system is configured to extend and retract the distal end of the rollable neck out of the arm. The distal end of the rollable neck is configured to hold a ball.

20 Claims, 12 Drawing Sheets

(56) References Cited

U.S. PATENT DOCUMENTS

| | | | | |
|---|---|---|---|---|
| 3,588,104 | A | 6/1971 | Griffin | |
| 3,589,632 | A * | 6/1971 | Rew | B21C 47/003 188/82.84 |
| 3,608,844 | A * | 9/1971 | Tumulty, Jr. | B21C 47/18 242/373 |
| 3,940,132 | A | 2/1976 | Lopatto, III | |
| 4,456,250 | A | 6/1984 | Perrone, Jr. | |
| 4,657,250 | A | 4/1987 | Newland | |
| 4,770,527 | A | 9/1988 | Park | |
| 4,815,735 | A | 3/1989 | McClenny | |
| 4,830,369 | A | 5/1989 | Poitras | |
| 4,834,375 | A | 5/1989 | Elstein | |
| 4,886,267 | A | 12/1989 | Licciardi | |
| 4,995,607 | A | 2/1991 | Whitfield | |
| 5,002,274 | A | 3/1991 | Bidema | |
| 5,046,729 | A | 9/1991 | Yancey | |
| 5,062,641 | A | 11/1991 | Poillon | |
| 5,160,131 | A | 11/1992 | Leon | |
| 5,228,683 | A | 7/1993 | Beimel | |
| 5,388,823 | A | 2/1995 | Prieto | |
| 5,401,016 | A | 3/1995 | Heglund et al. | |
| 5,590,876 | A | 1/1997 | Sejnowski | |
| 5,647,338 | A | 7/1997 | Martin | |
| 5,848,945 | A | 12/1998 | Miller | |
| 5,882,270 | A | 3/1999 | Daugherty | |
| 6,042,492 | A | 3/2000 | Baum | |
| 6,146,289 | A | 11/2000 | Miller et al. | |
| 6,167,878 | B1 | 1/2001 | Nickerson et al. | |
| 6,217,975 | B1 * | 4/2001 | Daton-Lovett | B29C 61/0608 156/161 |
| 6,256,938 | B1 * | 7/2001 | Daton-Lovett | F16H 19/064 138/119 |
| 6,296,582 | B1 | 10/2001 | Minniear | |
| 6,443,859 | B1 | 9/2002 | Markin | |
| 6,551,205 | B1 | 4/2003 | Koelzer, Jr. | |
| 6,695,723 | B2 | 2/2004 | Leal | |
| 7,169,067 | B2 | 1/2007 | Town | |
| 7,294,071 | B1 * | 11/2007 | Saumell | A63B 69/0053 473/418 |
| 7,828,679 | B2 | 11/2010 | Tell et al. | |
| D633,583 | S | 3/2011 | Guervara | |
| 8,425,352 | B1 | 4/2013 | LoDuca et al. | |
| 8,597,141 | B1 | 12/2013 | Daniel | |
| 9,033,828 | B2 | 5/2015 | LoDuca et al. | |
| 9,580,190 | B1 * | 2/2017 | Spence | B64G 1/222 244/172.6 |
| 10,004,655 | B2 | 6/2018 | Loduca | |
| 10,160,555 | B2 * | 12/2018 | Turse | B64G 1/222 244/172.6 |
| 2001/0003106 | A1 | 6/2001 | Brenneisen | |
| 2003/0064836 | A1 | 4/2003 | Moss et al. | |
| 2005/0101418 | A1 | 5/2005 | Cech | |
| 2005/0130770 | A1 | 6/2005 | Battisto | |
| 2005/0255945 | A1 | 11/2005 | Green | |
| 2007/0238554 | A1 * | 10/2007 | Hu | A63B 69/0075 473/417 |
| 2009/0082140 | A1 | 3/2009 | Liao | |
| 2012/0202621 | A1 | 8/2012 | Belt | |
| 2013/0061541 | A1 * | 3/2013 | Taylor | B29C 67/0014 52/108 |
| 2013/0196793 | A1 | 8/2013 | Murphy | |
| 2013/0218308 | A1 | 12/2013 | Altschuler et al. | |
| 2014/0230949 | A1 * | 8/2014 | Daton-Lovett | B64G 1/222 138/177 |
| 2015/0259911 | A1 * | 9/2015 | Freebury | E04C 3/005 52/108 |
| 2015/0284955 | A1 * | 10/2015 | Adams | E04C 3/005 52/108 |
| 2016/0325151 | A1 | 11/2016 | Coyne | |
| 2017/0298628 | A1 * | 10/2017 | Rakow | B64G 1/222 244/172.6 |
| 2018/0056160 | A1 | 3/2018 | LoDuca et al. | |

FOREIGN PATENT DOCUMENTS

| | | |
|---|---|---|
| JP | 08-066502 | 3/1996 |
| JP | 2000-504953 | 8/1997 |
| JP | H11-226164 | 8/1999 |
| JP | 2007-136137 | 6/2007 |

OTHER PUBLICATIONS

Notice of Reasons for Refusal dated Jun. 16, 2014, in JP Patent Application No. 2012-216004.

10m 4" Single Mast/RolaCare System User Guide, v.2, May 2018.

The Rollable Composite Structural Technology, Enhancing Capablity Whilst Reducing Weight/Bulk and Time Burden—Expeditionary Systems; www.rolatube-expeditionary-systems.com, printed Jun. 22, 2018.

The Rollable Composite Structural Technology, Enhancing Capatility Whilst Reducing Weight/Bulk and Time Burden—Extending Technology, www.rolatube.com, printed Jun. 22, 2018.

* cited by examiner

ROBOTIC BATTING TEE SYSTEM HAVING A ROLLABLE NECK

TECHNICAL FIELD

The present disclosure is related to baseball or softball batting tees, and more specifically, to a robotic batting tee system having a rollable neck.

BACKGROUND

Hitting a baseball or softball is one of the most difficult skills of all sports to master. Attempts at mastery require batting practice, often taking the form of tee work. Indeed, tee work in baseball is heavily promoted, encouraged, and even mandated as a training tool at all levels of competition, from Little League to the Majors. The main purpose of tee work is to aid batters in maintaining consistent form in their swing path so that contact with the ball will produce line drive hits. Batting tees generally have a ball holder that extends from a home plate shaped support. The ball holder may be mounted along an adjustable neck allowing the player or coach to grasp the neck to adjust the height of the ball holder relative to the base shaped support and hence the ball when positioned on the holder. In use, a hitter takes their stance adjacent to the tee and hits the ball off the ball holder.

SUMMARY

According to various examples, the present disclosure describes a batting tee system that seeks to shift the paradigm of tee work that historically defines "muscle memory" from a historical mode of "repetition" to a new methodology that embraces "randomization". By embedding randomization software, for example, within a robotic (mechanical) batting tee apparatus, batters can be prevented from sequentially hitting balls off of the tee in the same consecutive spot. This randomization approach prevents "locking in" a batter's swing path or swing "groove" to a particular point or area within a batter's strike zone. Hence, the methodology of randomization produces a contextual interference effect that drives enhanced flexibility and fluidity to make better contact anywhere in the strike zone and not just in areas where a batter feels they are most proficient (e.g., the batter's "hot zone"). It is believed that contextual interference and randomization modes as applied to sport specific training provide longer term learning patterns as well.

In one example, a batting tee system includes a housing, an arm coupled to the housing, and an actuation system. The actuation system includes a spool positioned within the arm and configured to rotate, a rollable neck, and an actuator coupled to the spool. The rollable neck has a proximal end coupled to the spool, and further has a distal end. The rollable neck is configured to be wound around the spool when the spool rotates in a first direction and is further configured to be unwound from the spool when the spool rotates in a second direction. Also, the rollable neck is configured to have a flat form when wound around the spool and is further configured to transition from the flat form to a hollow tube form when unwound from the spool. The actuator is configured to rotate the spool in the first and second directions. The actuation system is configured to extend and retract the distal end of the rollable neck out of the arm along a vertical axis. When the distal end of the rollable neck extends out of the arm along the vertical axis, the distal end is configured to hold a ball. The system further includes a control system coupled to the actuation system and configured to cause the actuation system to extend or retract the distal end of the rollable neck.

In another example, a batting tee system includes a housing; an arm coupled to the housing and configured to move from a horizontal position to a vertical position; and an actuation system. The actuation system includes a spool positioned within the arm and configured to rotate; a rollable neck having a proximal end coupled to the spool and further having a distal end; and an actuator coupled to the spool and configured to rotate the spool in first and second directions. The rollable neck is configured to be wound around the spool when the spool rotates in the first direction and is further configured to be unwound from the spool when the spool rotates in the second direction. The rollable neck is configured to have a flat form when wound around the spool and is further configured to transition from the flat form to a hollow tube form when unwound from the spool. The actuation system is configured to extend and retract the distal end of the rollable neck out of the arm along a vertical axis. When the distal end of the rollable neck extends out of the arm along the vertical axis, the distal end is configured to hold a ball. The system further includes a control system coupled to the actuation system and configured to cause the actuation system to extend or retract the distal end of the rollable neck to a first random position out of the arm and along the vertical axis. The control system is further configured to cause the actuation system to extend or retract the distal end of the rollable neck from the first random position to a second different and random position out of the arm and along the vertical axis, after the ball is hit from the distal end of the rollable neck when the distal end is in the first random position.

The control system may further include a ball presence sensor positioned to collect ball presence data that the control system analyzes to determine if the ball has been hit from the distal end of the rollable neck.

In some examples, the ball presence sensor may include a camera trained to detect a particular color. The camera may be positioned to view an inside portion of the rollable neck when the distal end of the rollable neck extends out of the arm along the vertical axis. The ball presence sensor may further include a mirror angled to reflect light waves to the camera through a longitudinal gap extending along the length of the hollow tube form.

In some examples, the ball presence sensor may include a laser emitter module that includes a laser emitter configured to emit a beam of light towards the distal end of the rollable neck. The laser emitter module may further include a laser detector configured to detect when at least a portion of the beam of light is reflected back towards the ball presence sensor. The ball presence sensor may further include an adjustable casing configured to couple the ball presence sensor to a portion of the arm or a portion of the rollable neck. The adjustable casing may include an inner circumference configured to change in size. The laser emitter module may be attached to the inner circumference of the adjustable casing. The rollable neck may extend in-between the laser emitter module and the inner circumference of the adjustable casing when the distal end of the rollable neck extends out of the arm along the vertical axis.

In some examples, the ball presence sensor may include a bracket configured to attach the ball presence sensor to a portion of the arm; a laser emitter module having a laser emitter configured to emit a beam of light, where the laser emitter module is attached to an inner circumference of the bracket; and a camera configured to detect at least a portion of the beam of light emitted onto a ball. The camera may be pivotally coupled to the bracket and configured to pivot in relation to the bracket to track the distal end of the rollable neck. The rollable neck may extend in-between the laser emitter module and the inner circumference of the bracket when the distal end of the rollable neck extends out of the arm along the vertical axis.

In some examples, the rollable neck may be completely retractable into the arm. The arm may be configured to be manually or automatically moved from the horizontal position to the vertical position. The hollow tube form of the rollable neck may include a longitudinal gap extending along the length of the hollow tube form. The rollable neck may be made from spring steel. The control system may select the first random position and the second different and random position using a random number generator. The control system may randomly select the first random position and the second different and random position from a pre-stored list of possible heights.

BRIEF DESCRIPTION OF THE DRAWINGS

For a more complete understanding of the present disclosure and its features and advantages, reference is now made to the following description, taken in conjunction with the accompanying drawings, in which.

DESCRIPTION

Figure 1:
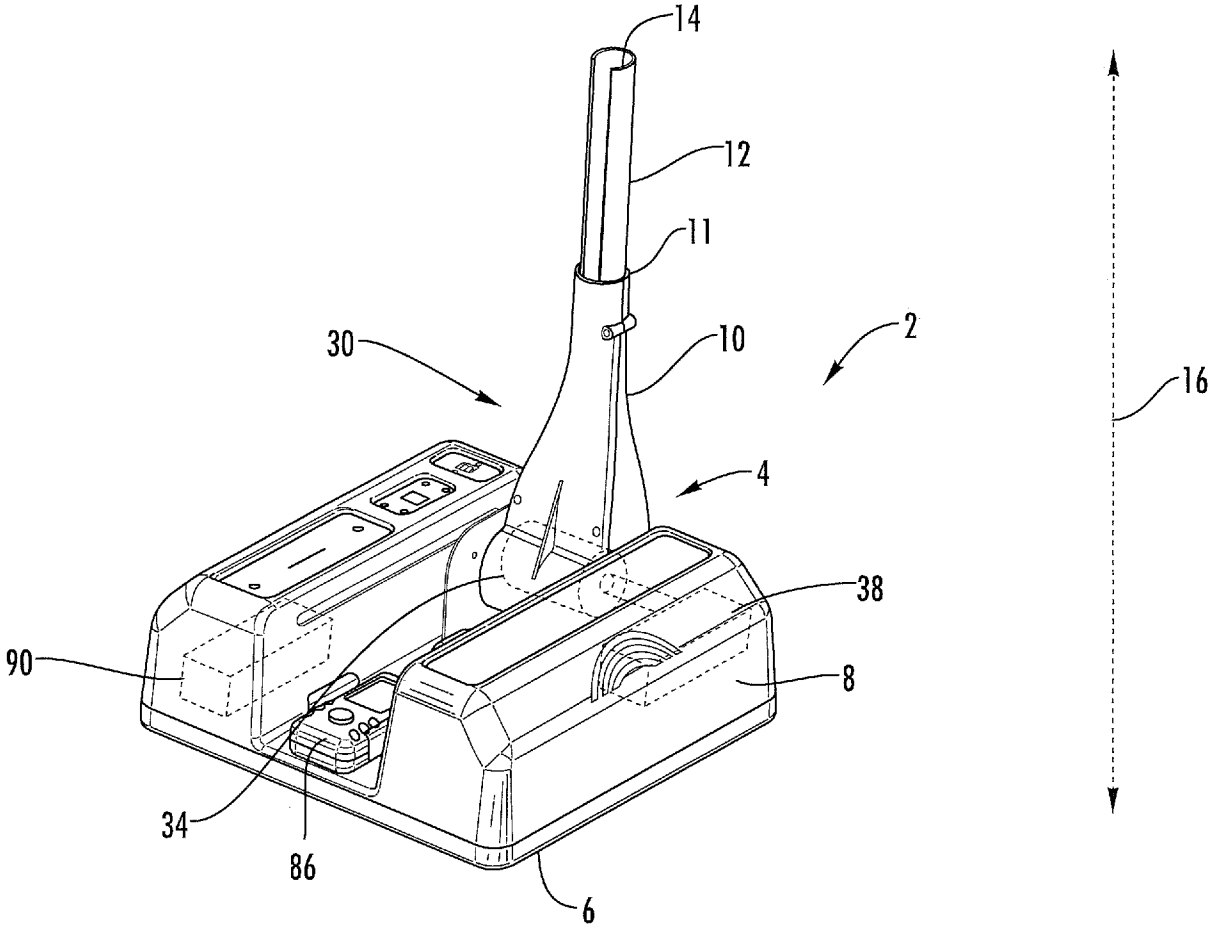
FIG. 1 is a perspective view of an example tee system.

Batters participating in tee work will typically position a ball holder of a batting tee based on individual preferences for comfort or hot zones. Balls are repeatedly placed on the ball holder, hit, and replaced. This repetitious hitting of balls positioned at the same spot creates muscle memory or a proprioceptive-neurological pathway that locks in a motor muscular swing path or groove to a particular spot within the strike zone. In baseball, batters have milliseconds to perceive an incoming pitch and square up by positioning their arms and hands to meet the center of the ball with the barrel of the bat. When batters require motor muscular flexibility in the game to meet an incoming pitch, their swing path will automatically and involuntarily be driven to a positional spot where a baseball has been hit hundreds or thousands of times during tee work. Hence, the swing path becomes preprogrammed, seemingly more robotic than robots themselves.

Although batters may move the tee to the inner, outer, front, or back portions of the strike zone, typically the ball will be repetitively replaced on the ball holder positioned at the same height. This is true even where the height of the ball holder may be adjusted by grasping the neck and physically extending or shortening the neck. In these instances, while the ball is correspondingly moved to various portions of the strike zone, the batter is repeatedly hitting the ball in the same spatial plane, which provides little resolution to train to the fullest flexibility within the strike zone.

Without being bound to theory, it is believed that the brain works in a paradoxical manner with respect to hitting. That is, while the brain prefers repetition (utilizing brain pathways most often used or of least resistance) it can only learn when it is stretched (fostering neural plasticity) or presented with unfamiliar or novel experiences ("opening" and "activating" dormant or unused neural pathways). In this respect, traditional tee usage may actually inhibit rather than foster hand-eye coordination.

A tee system is described herein which may be used to teach consistent good contact, with consistent good form, anywhere in the strike zone, not just where a batter feels most proficient. The tee system may position a ball holder (e.g., a distal end of a rollable neck) at various heights along an axis. Movement of the ball holder between the height positions along the axis may be automated (robotic). The selection of the height positions may also be automated. For example, a control system may be programmed with height position data used to execute selection of height positions. The height position data may include one or more sequences of height positions. The height position data may include one or more generated sequences of random height positions. The number of height positions in a sequence or number of sequences may be large enough such that a batter is unlikely to perceive or unconsciously key in on height positions as to anticipate repetition over multiple exposures to the sequence. Sequences may be associated with ranges of heights, which may be selected by a user. In some instances, the control system may be configured to skip height positions within a sequence that are outside a range set by a user. The control system may also be programmed to generate height position data comprising random height positions within a range of height positions.

The tee system and components for use with tee systems are described further below with reference to FIGS. 1-14, wherein like numerals are used to identify like features.

As is illustrated in FIG. 1, the tee system 2 includes a body 4 having a base 6, a housing 8 positioned on the base 6, an arm 10 extending vertically from the housing 8, and a rollable neck 12 extendable and retractable from the arm 10. The rollable neck 12 includes a distal end 14 that operates as a ball holder for the tee system 2 (e.g., the ball may be positioned on the distal end 14).

The tee system 2 is preferably configured to be manportable, yet stable enough to prevent falling over due to a mishit from a batter. For example, the base 6 may provide a stable platform for mounting of the arm 10, rollable neck 12, and other components without adding unnecessary weight to the system 2. The base 6 may be wider than the housing 8, longer than the housing 8, or both to provide stability. The base 6 may include a rubber-like lower surface to increase friction with the ground surface upon which the body 4 may be placed.

Figure 11:
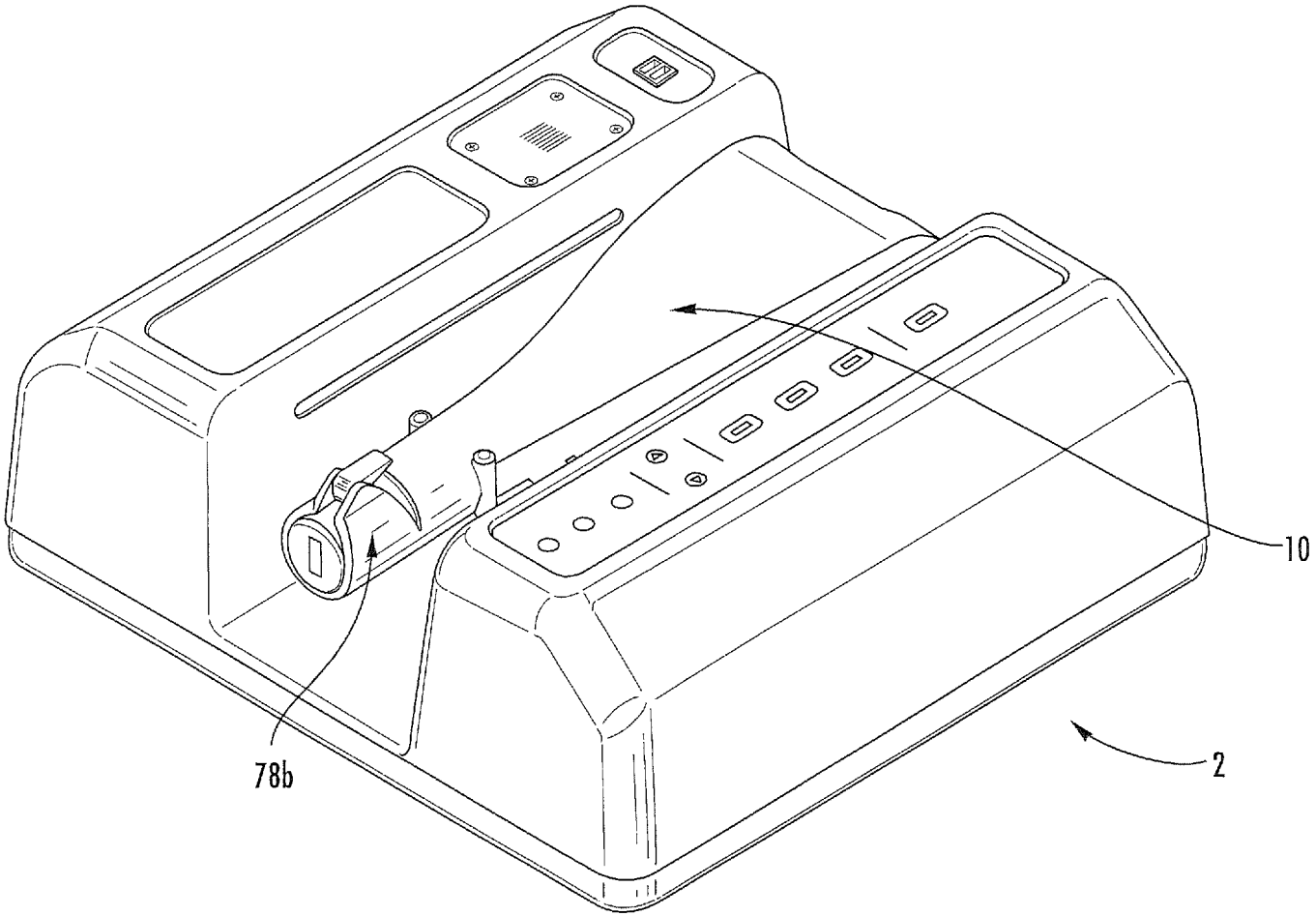
FIG. 11 illustrates a detailed view of the ball presence sensor of FIG. 10 positioned on an arm of the system of FIG. 1, while the arm is in the horizontal position.

The arm 10 is pivotally attached to the housing 8 at a first end. This pivoting attachment may allow the arm 10 to pivot from a horizontal position to a vertical position (and vice versa). As is illustrated in FIG. 1, the arm 10 is positioned at a vertical position where the arm 10 extends from the housing 8 along a vertical axis (i.e., extends vertically). When in the vertical position, the rollable neck 12 may extend and retract from the arm 10, allowing a hitter to hit a ball from the distal end 14 of the rollable neck 12. The arm 10 may further be positioned at a horizontal position where the arm 10 extends from the housing 8 along a horizontal axis (i.e., extends horizontally). An example of an arm 10 positioned in the horizontal position is illustrated in FIG. 11. As is discussed above, the arm 10 may be pivoted from the horizontal position to the vertical position (and vice versa).

The arm 10 may be pivoted to the vertical position when the hitting system 10 is in use (e.g., when the system 2 is turned on). Furthermore, the arm 10 may be pivoted to the horizontal position when the hitting system 2 is not in use (e.g., when the system 2 is turned off). It may also be pivoted to the horizontal position when a user is transporting the system 2. This may reduce the size of the system 2, allowing it to more easily be carried and/or more easily positioned in a case or cover. In some examples, the system 2 (with the arm 10 in the horizontal position) may fit entirely within a travel case having a handle. This handle may be gripped by a user for transporting the tee system 2. In other examples, the system 2 may have a handle, allowing the system 2 to be carried without a travel case. In such examples, the arm 10 (in the horizontal position) and a portion of the housing 8 may be covered by a removable cover.

The arm 10 may be manually pivoted from the horizontal position to the vertical position (or vice versa). In such an example, a user may manually move the arm 10.

Additionally, the system 2 may include a motor (or other actuating device) that may automatically pivot the arm 10 from the horizontal position to the vertical position (or vice versa). In such an example, when the system 2 is turned on, the actuating device may turn on and automatically pivot the arm 10 to the vertical position. Also, when the system 2 is turned off, the actuating device may automatically pivot the arm 10 to the horizontal position, and then turn off.

The system 2 further includes the rollable neck 12 having the distal end 14. The distal end 14 of the rollable neck 12 may move upward along a vertical axis 16 (indicated by a double arrow) in relation to the arm 10, causing the rollable neck 12 to extend out of the end portion 11 of the arm 10. Additionally, the distal end 14 of the rollable neck 12 may also move downward along the vertical axis 16 in relation to the arm 10, causing the rollable neck 12 to retract into the arm 10. This may allow the distal end 14 to extend and/or retract to any height above the end portion 11 of arm 10, and also may allow the distal end 14 to retract entirely within the arm 10.

Figure 2:
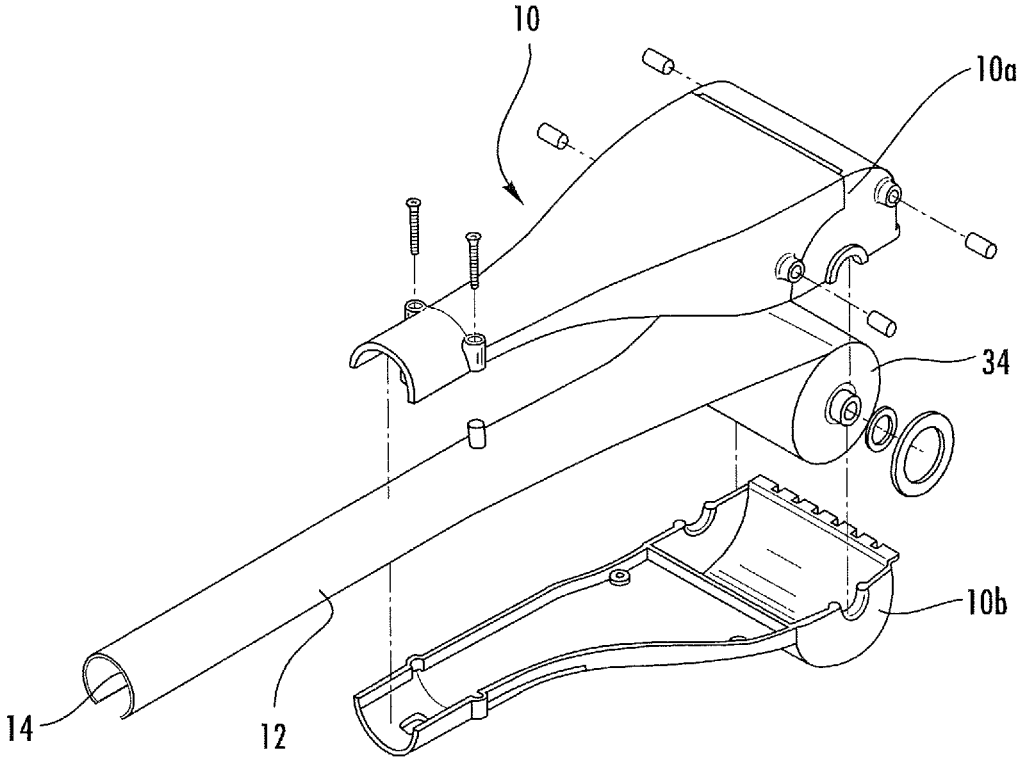
FIG. 2 is an exploded view of an example arm and spool of the system of FIG. 1.
Figure 3:
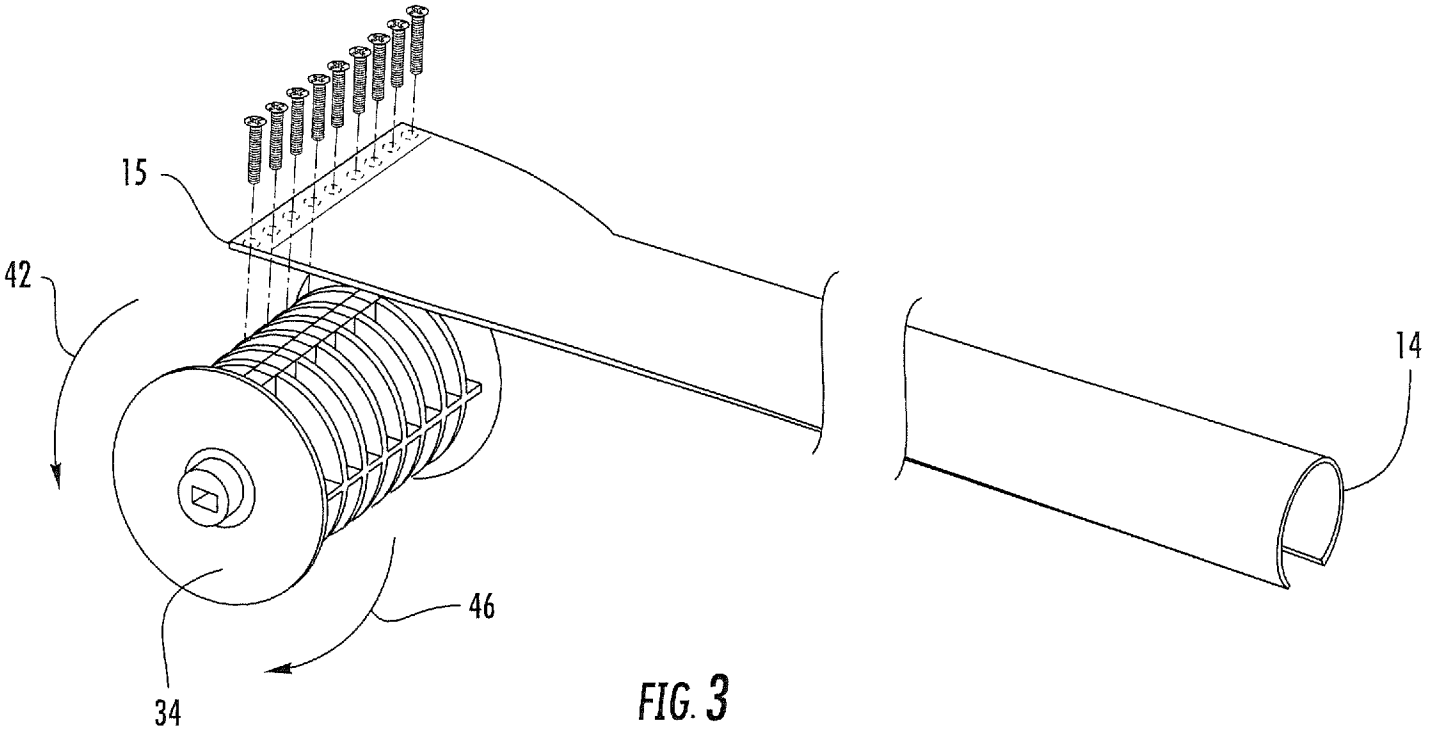
FIG. 3 is an exploded view of an example spool and rollable neck of FIG. 1.

To move the rollable neck 12, the system 2 may further include an actuation system 30. As is illustrated in FIG. 1, the actuation system 30 may include the rollable neck 12, a spool 34, and an actuator 38. The spool 34 may be positioned within the arm 10 (as is shown in FIG. 1 and FIG. 2, where the spool 34 is positioned within 2 opposing sections 10*a* and 10*b* of the arm 10). A proximal end 15 of the rollable neck 12 may be attached to a portion of the spool 34, as is illustrated in FIG. 3. The proximal end 15 may be attached to the spool 34 in any manner (e.g., screws, bolts, nails, adhesive, clasp(s)). As is illustrated, the proximal end 15 is attached to the spool 34 by screws. The actuator 38 may be attached to the spool 34, and may rotate the spool 34. The actuator 38 may be any device that rotates the spool 34 or causes the spool 34 to rotate (e.g., a motor, a crank). As is illustrated, the actuator 38 is a motor, such as an IG42 24 VDC 240 RPM motor. The motor may be an electric, hydraulic, or pneumatic motor. To rotate the spool 34, the actuator 38 may transmit rotational force to the spool 34, causing the spool 34 to rotate around an axis.

In operation, the spool 34 may be rotated (by the actuator 38) in a first direction 42 (e.g., counterclockwise), as is illustrated in FIG. 3. This rotation in the first direction 42 may wind the rollable neck 12 around the spool 34, causing the distal end 14 of the rollable neck 12 to move downward along the vertical axis 16. In some examples, the winding of the rollable neck 12 may cause the distal end 14 to be retracted entirely within the arm 10. Furthermore, in some examples, the winding of the rollable neck 14 may further cause the entire rollable neck 12 to be wound around the spool 34. In such examples, the distal end 14 of the rollable neck 14 may also be wound around the spool 34.

The spool 34 may also be rotated (by the actuator 38) in a second direction 46 (e.g., clockwise). This rotation in the second direction 46 may unwind the rollable neck 12 from the spool 34, causing the distal end 14 of the rollable neck 12 to move upward along the vertical axis 16. As is illustrated in FIG. 1, this unwinding may cause the distal end 14 to extend out of the end portion 11 of the arm 10. It may further cause the distal end 14 to extend to any height out of the end portion 11 of the arm 10. In some examples, the actuation system 30 may actuate the rollable neck 12 to extend the distal end 14 of the rollable neck 12 to approximately 20 inches above the ground (or other surface), approximately 25 inches above the ground, approximately 30 inches above the ground, approximately 35 inches above the ground, or more. In some examples, the actuation system 30 may actuate the rollable neck 12 to extend the distal end 14 of the rollable neck 12 to a position that is within a range of approximately 17 inches to approximately 48 inches above the ground (where the measurement is taken between the lower side of the base 6 and the distal end 14 of the rollable neck 12).

To wind around the spool 34, the rollable neck 12 may have a first flat form. An example of the first flat form is shown in FIG. 3 (at the proximal end 15) and further shown in FIG. 4 (on the left side). Additionally, to hold a ball, the rollable neck 12 may have a second hollow tube form. An example of the second hollow tube form is shown in FIG. 1 (at the distal end 14) and further shown in FIGS. 4-6. The hollow tube form may have a substantially circular cross-section, with a longitudinal gap extending along the length of the hollow tube form. The circular cross-section may have any size that allows the hollow tube form to hold a ball at the distal end 14.

When wound around the spool 34, the rollable neck 12 may have the first flat form. However, as the rollable neck 12 is unwound from the spool 34, the unwound portion of the rollable neck may transition to the second hollow tube form. Furthermore, as the rollable neck 12 is re-wound around the spool 34, that portion may re-transition back to the first flat form. This transition between the first flat form and the second hollow tube form (and vice versa) is a characteristic of the structure (and material(s)) of the rollable neck 12, in some examples. The rollable neck 12 may have any structure (and may be made of any material(s)) that allows it to transition from the first flat form to the second hollow tube form (and vice versa).

Figure 4:
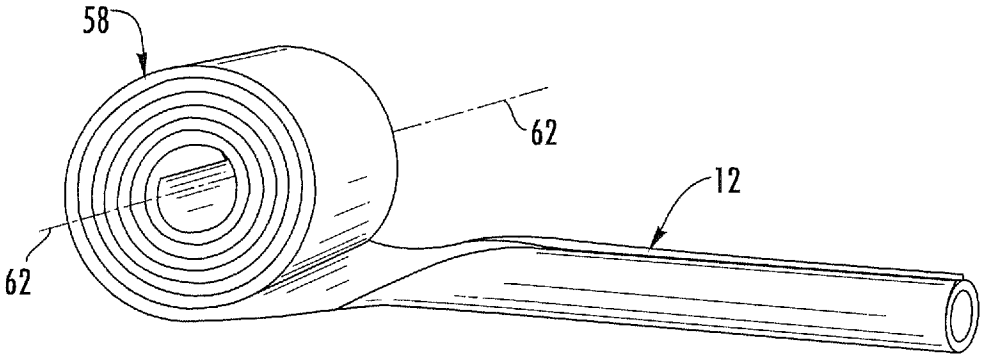
FIG. 4 is a perspective view of an example rollable neck of FIG. 1.
Figure 6:
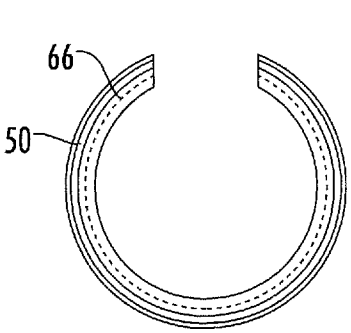
FIGS. 5 and 6 are cross-sectional views of a section of the example rollable neck of FIG. 4.
Figure 5:
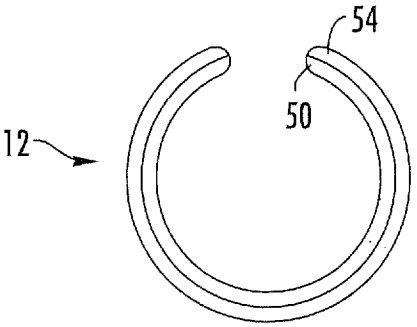

FIGS. 4-6 show an example of the structure of the rollable neck 12. As illustrated, the rollable neck 12 includes an elongate substrate 50, made from a resilient material (e.g., prestressed plastics material, spring steel, non-ferrous alloys such as beryllium copper, spring metal or a mesh, or any combination of the preceding). The substrate 50 may be preformed such that it is biased to its hollow tube form (e.g., an elongate, longitudinally split tube having substantially circular cross-section). This bias causes the substrate to stay in the hollow tube form, unless it is forced into its flat form (e.g., forced by the winding of the rollable neck 12 around the spool 34). A layer 54 of a plastics material may be laminated to the outer surface of the substrate 50. The plastics material of the layer 54 may be subject to plastic deformation at ambient temperatures.

The rollable neck 12 may be wound to form a coil 58 by progressively flattening out the rollable neck 12 against the bias of the substrate 50, and then rolling the material about an axis 62 that extends transversely relative to the longitudinal extent of the rollable neck 12. That is, the winding of the rollable neck 12 into the coil 58 (e.g., a coil around the spool 34) may overcome the substrate 50's bias, causing the rollable neck 12 to transition from its biased hollow tube form to the flat form. The rollable neck 12 may be held in its coiled state (in a flat form) by spool 34 (not shown).

As the rollable neck 12 is coiled, the plastics material of the layer 54 may undergo plastic deformation such that the layer 54 becomes biased in favor of the coiled state. Accordingly, in the coiled state, the plastics material layer 54 may be opposing, or even negating, the potential energy which has been stored in the substrate 50 in the formation of the coil 58. This may render the coil 58 much more stable than a comparable coil made from the substrate 50 alone and may make it possible for very strong spring substrates to be coiled with safety.

As the rollable neck 12 is unwound from the coil 58 (e.g., unwound from the spool 34), the plastics material 54 becomes tensioned transversely of the rollable neck 12. This may provide stability to the hollow tube form, which has sufficient rigidity to be self-supporting. Furthermore, as flattening of the rollable neck 12 relieves this tension of the layer 54, the transversely tensioned layer may effectively oppose the transition to the hollow tube form, and therefore may aid in the rolling of the coil 58 against this bias towards the hollow tube form.

As is illustrated in FIG. 6, in some examples, a plurality of longitudinally extending prestressed fibers 66 (which are under tension in this extended form of the rollable neck 12) may be bonded to the inner surface of the substrate 50. These tensioned longitudinally extending fibers 66 may favor formation of the coil 58, as the coil 58 at least partially relieves this tension. Similarly, once the rollable neck 12 is in the coiled state, the tensioned longitudinally extending fibers 12 may oppose the unrolling of the coil 58 and therefore may ensure that the rollable neck 12 is stable in its coiled state. Additionally, or alternatively, the substrate 50 may be provided with transversely, extending fibers (not shown) to oppose curving of the element into its hollow tube form. These transversely extending fibers may be affixed to the external surface of the substrate 50. These transversely extending fibers are under tension when the rollable neck 12 is in its hollow tube form, but this tension is at least partially relieved when the rollable neck 12 is in its flat form.

The prestressed fibers longitudinally extending prestressed fibers 66 and transversely extending fibers) may be prestressed glass or carbon fibers affixed to the substrate 50. Alternatively, these fibers may be embedded in the respective plastics material layer 54 bonded or otherwise laminated to the substrate 50. Addition ally, or alternatively, prestressed graphite bands and/or tensioned bands of rubber or plastics material could be affixed relative to tae substrate 50.

Additional examples of the rollable neck 12 are discussed in further detail in U.S. Pat. No. 6,256,938 issued Jul. 10, 2001 and entitled "Elongate Hollow Element" (which is incorporated herein by reference). A further example of the rollable neck 12 may include the RolaTube sold by RTL Materials Ltd (trading as RolaTube Technology).

Use of the rollable neck 12 in the tee system 2 may allow the tee system 2 to have a lower profile and/or be more man-portable, in some examples. For example, as is discussed above, the rollable neck 12 may be wound around the spool 34. This may allow the rollable neck 12 to have a long length (e.g., a length that could extend the distal end 14 of the rollable neck 12 above the ground by 48 inches or more), but may also prevent the rollable neck 12 from taking up much space in the body 4 and housing 8. As such, the dimensions of the body 4 and/or housing 8 may be reduced by use of the rollable neck 12, causing the system 2 to have a lower profile and/or be more man-portable, in some examples.

Use of the rollable neck 12 in the tee system 2 may also allow the tee system 2 to better handle mishits by a user. Typically, when a batter accidentally hits the neck portion of a tee system (as opposed to a ball), the neck portion may be damaged. In contrast, the structure and/or material(s) (e.g., spring steel) of the rollable neck 12 may allow the rollable neck 12 to crumple over when hit, and then re-form back to its original shape (e.g., re-form back to the hollow tube form). This may reduce damage to the rollable neck 12, and may further reduce injury to the user.

Figure 7:
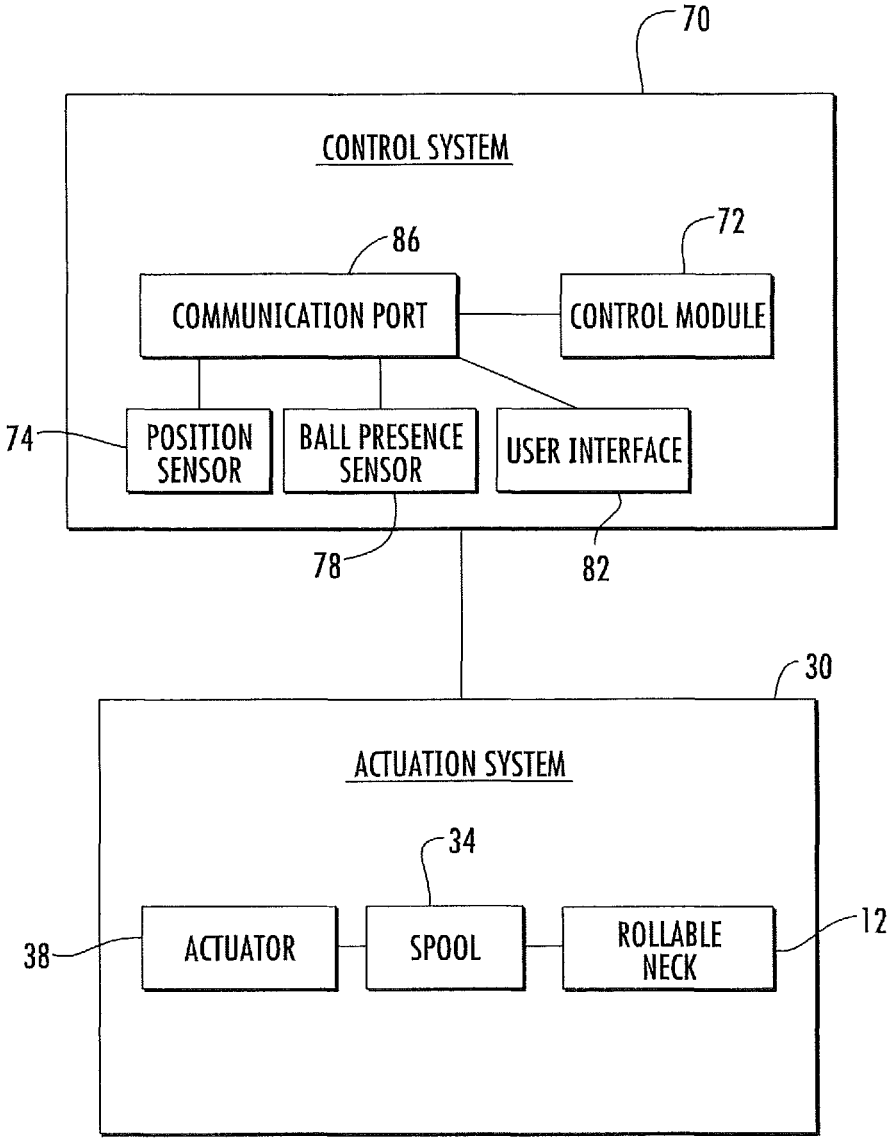
FIG. 7 is a schematic view of an example control system and actuation system of the system of FIG. 1.

As is illustrated in FIG. 7, the tee system 2 may further include a control system 70 to control the operations of the tee system 2. The control system 70 may control the actuation system 30, thereby controlling the movement of the rollable neck 12 along the axis 16. For example, the control system 70 may provide for randomization of the movement of the rollable neck 12 along the axis 16. This randomization may prevent the actuation system 30 from actuating the rollable neck 12 to the same position consecutively (e.g., the distal end 14 of the rollable neck 12 may not be positioned at the same height consecutively). During randomization, the control system 70 will not allow a user to keep the rollable neck 12 at the same height for more than one hit, with the idea that a batter should not hit a ball in the same consecutive spot.

According to the illustrated example, the control system 70 includes a control module 72. The control module 72 may include a processor configured to execute instructions in order to perform the functions of the control system 70 (e.g., provide randomization). The control module 72 may further include a memory for storing these instructions executable by the processor. Alternatively, the instructions may be hardwired into the processor.

The control system 70 may also include one or more position sensors 74 that allow the control system 70 to determine a position corresponding to the current position of the rollable neck 12 (e.g., the current position of the distal end 14 of the rollable neck 12). The position sensor 74 may be any sensor that can detect or otherwise determine the current position of the rollable neck 12. As an example, the position sensor 74 may be a potentiometer or other sensor that monitors the rotation of a disc drive of the actuator 38

(which corresponds to the height position of the distal end 14 of the rollable neck 12). As another example, the position sensor 74 may be a potentiometer or other sensor that monitors the rotation of the spool 34 (which also corresponds to the height position of the distal end 14 of the rollable neck 12). The potentiometer may be a multi-turn potentiometer, for example, providing for simple determination of the height position of the distal end 14 of the rollable neck 12 at any point in time after being powered ON. In this or another example, the control system 70 incorporates a stepper motor or servomotor configured with position control incorporating an encoder or potentiometer in a closed loop. The control system 70 may also include a PID controller, for example, to receive and interpret the position data and provide corresponding control signals to control operation of the actuation system 30.

The control system 70 may also include one or more ball presence sensors 78 to detect the presence of the ball. The sensor(s) 78 may be used to determine when a ball has been hit, so as to know when to actuate the rollable neck 12 to its next position (e.g., its next random position). The ball presence sensor 78 may incorporate any suitable sensor technology. For example, the ball presence sensor 78 may detect vibration or movement of the rollable neck 12, may detect movement of a ball from the distal end 14 of the rollable neck 12, and/or may detect weight of or weight change with respect to the rollable neck 12. As other examples, the ball presence sensors may utilize light or optical sensors, sound sensors, or other suitable sensors in order to detect the presence of the ball (or to detect when the ball is no longer present). In some examples, the ball presence sensor 78 may include an IR proximity line-of-sight sensor used to detect the presence of a ball on the distal end 14 of the rollable neck 12. Information provided by the ball presence sensors 78 to the control system 70 may be referred to as ball presence data. Further examples of ball presence sensors 78 are discussed in detail below with regard to FIGS. 9-14.

The position sensors 74 and/or ball presence sensors 78 may be wired to the control module 72 or may be configured for wireless communication with the control module 72 (or both). For example, the control system 70 may utilize Bluetooth communications to receive information from the position sensors 74 and/or ball presence sensors 78.

The control system 70 may further include a user interface 82. The user interface 82 may allow the system 2 to provide information to a user (e.g., ball height information), may allow a user to provide information to the system 2 (e.g., characteristics, such as the height of the hitter), or both. The user interface 82 may be a local user interface that is attached to the system 2. Alternatively (or additionally), the user interface 82 may be a remote user interface that may be used remotely from the system 2. As is illustrated in FIG. 1, the user interface 82 is a remote user interface (e.g., a remote) that may be removed from the body 8 and that may be used remotely from the system 2.

The user interface 82 may provide information to a user. For example, the user interface 82 may display information that indicates the current height of the ball (e.g., 24 inches), information that indicates that the rollable neck 12 is currently moving, information that indicates that the user can place a ball on the distal end 14 of the rollable neck 12, any other information, or any combination of the preceding. In some examples, the user interface 82 may include a display (e.g., LED indicators) to inform the user about the operational state of the tee system 2. For example, a red LED may indicate actuation (e.g., when the rollable neck 12 is about to move, is moving, or both), and a green LED may indicate that the rollable neck 12 is properly positioned and a ball can be placed on the distal end 14.

The user interface 82 may also allow a user to provide information to the system 2. For example, a user may specify a height zone range (e.g., a range between 17 inches to 48 inches) within which the control system 70 will allow the rollable neck 12 to be moved. In such an example, the control system 70 may cause the actuation system 30 to move the rollable neck 12 only within the specified height range. As another example, a user may turn ON randomization of the system 2. This randomization may prevent the actuation system 30 from actuating the rollable neck 12 to the same position consecutively (e.g., the distal end 14 of the rollable neck 12 may not be positioned at the same height consecutively). As a further example, a user may turn OFF randomization of the system 2, or a user may pause randomization of the system 2. This may cause the actuation system 30 to keep the distal end 14 of the rollable neck 12 positioned at the same height consecutively, or may cause the actuation system 30 to move the distal end 14 of the rollable neck 12 to a pre-selected height (or position). As further examples, a user may select a particular height to position the distal end 14 (and ball) at, a user may select a particular set of heights to progress through (e.g., particular sequence of heights), a user may select a particular pre-stored training program, or a user may provide any other information to the system 2.

The control system 70 may also include one or more communication ports 86. The communication port 86 may include a receiver, transmitter, transceiver, any other communication device, or any combination of the preceding. For example, the communication port 86 may be a transceiver configured for wired communication, wireless communication (e.g., Bluetooth, IR, Wi-Fi, radio), or both. The communication port 86 may allow communication between the control module 72 and other components or devices (e.g., position sensors 74, ball sensors 78, user interface 82). In some examples, the communication port 86 may allow communication between the control system 70 and the actuation system 30. In other examples, a separate interface may allow communication between the control system 70 and the actuation system 30.

In some examples, the communication port 86 may communicate with a remote device (e.g., a computer, laptop computer, tablet, smart phone/device, dedicated remote device, hearing device, tactile-vibration feedback device, or combination thereof) to provide a remote interface. For example, the communication port 86 may include Bluetooth communication hardware to wirelessly pair the control system 70 with a smart phone. Thus, the user may utilize a mobile application running on the smart phone to send information to the tee system 2 (e.g., send a particular height range to the tee system 2) and/or receive information from the tee system 2 (e.g., receive data on the current or previous heights of the rollable neck 12).

To operate, the tee system 2 may include (or may be coupled to) a power source to provide power to the tee system 2. For example, the tee system 2 may be powered by a power source that includes one or more batteries, an a/c outlet, or combination thereof. In the example illustrated in FIG. 1, the tee system 2 includes an onboard (associated with or mounted on the body 4) rechargeable battery 90 of the SLA or LiPo type. This battery 90 may be removed for charging, or it may be charged by plugging the tee system 2 into an a/c outlet (using a removable extension cord, for example). In some examples, the battery 90 may provide power to the sensors 74 and 78. In other examples, one or more of the sensors 74 and 78 may have their own batteries for powering the sensors. In such examples, the sensors 74 and 78 may be individually plugged into an a/c outlet to re-charge the batteries, or the batteries may be replaced.

Figure 8:
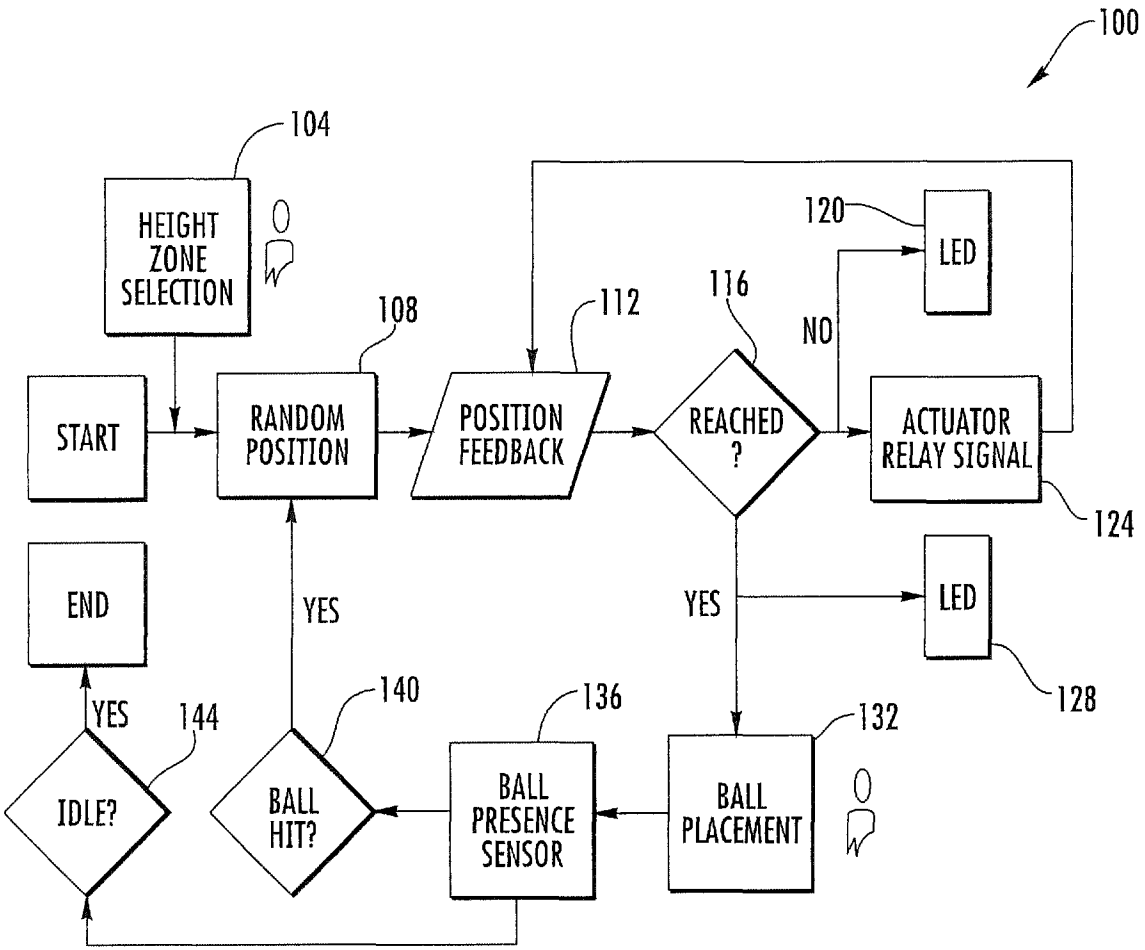
FIG. 8 is a flowchart depicting an example operation of the control system of FIG. 7.

FIG. 8 is a flowchart 100 depicting an example operation of the control system 70 of FIG. 7. At step 104 of flowchart 100, the control system 70 receives a height zone selection from a user, which may be entered or selected at a user interface 86 (e.g., the remote user interface illustrated in FIG. 1). The height zone selection may include a minimum and maximum height (e.g., a range between approximately 18 inches off the ground to 47 or 48 inches off the ground). This height zone selection is generally based on the height of the user, stance, and strike zone, such as major league strike zone rules. In some examples, the control system 70 may not receive a height zone selection (e.g., when a user decides to not input one). In such examples, the control system 70 may utilize a generic height zone selection (e.g., a height selection based off the average height of a human). In other examples, the control system 70 may receive an input of the height of the user, and the control system 70 may calculate the height zone selection using the inputted height.

At step 108, the control system 70 may select an initial height position for the rollable neck 12. The selected initial height position may be a random position within the range of the height zone selection. The control system 70 may select this random position using, for example, a random number generator that generates a random number within the set range. As another example, the control system 70 may select this random position by randomly selecting a position from a pre-stored list of possible heights (e.g., a list of heights that were previously entered by a user, a list of heights that were previously designated as being problematic for a hitter, a list of every possible height within the height zone selection).

Following selection of the initial height position, the control system 70 may signal the actuation system 30 (using a relay signal, for example) to move the rollable neck 12 to the selected initial height position. To move the rollable neck 12, the actuator 38 may rotate the spool 34 in the second direction (e.g., clockwise), causing the rollable neck 12 to progressively unwind from the spool 34. As the rollable neck 12 unwinds from the spool 34, the unwound portion of the rollable neck 12 may transition from the flat form to the hollow tube form (as is discussed above). Furthermore, the rollable neck 12 may extend away from the spool 34 and travel upwards through the arm 10. The rollable neck 12 may then emerge from the end portion 11 of the arm 10, and continue to move upwards along the axis 16.

As the rollable neck 12 (and the distal end 14 of the rollable neck 12) move upwards along the axis 16, a position sensor 74 (e.g., a potentiometer) may detect position data and provide position feedback to the control module 72 at step 112. Using this position feedback, the control system 70 may determine whether the initial height position has been reached, at step 116. If the position has not been reached, the control module 72 may cause the user interface 82 (e.g., a local user interface or the remote user interface) to emit a red light (at step 120) or other indication, and the control module 72 may further send a relay signal (at step 124) to the actuation system 30 to signal the actuation system 30 to continue to move the rollable neck 12 upwards.

Alternatively, if the position has been reached, the control system 70 may signal the actuation system 30 to stop moving the rollable neck 12. Also, the control module 72 may cause the user interface 82 to emit a green light (at step 128) or other indication, indicating that the user may place the ball on the distal end 14 of the rollable neck 12. In some examples, the user interface 82 (or the tee system 2) may include a speaker that indicates (via one or more audible sounds) that the user may place the ball on the distal end 14 of the rollable neck 12

At step 132, a user may position the ball on the distal end 14 of the rollable neck 12. This positioning of the ball on the distal end 14 may be detected by one or more ball presence sensors 78 at step 136. The ball presence sensors 78 may generate ball presence data and provide the ball presence data to the control module 72, so that the control module 72 may determine whether the ball has been hit off of the rollable neck 12, at step 140. If the ball presence data indicates that the ball has not been hit off the rollable neck 12 yet, the control system 70 may continue to wait for the ball to be hit off. If the wait is too long (e.g., longer than a predetermined amount of time), the control system 70 may determine that the user has stopped using the tee system 2 (e.g., the system 2 has gone idle). For example, the control system 70 may utilize ball presence data received from the ball presence sensor 78 in order to determine that the ball has been positioned on the distal end 14 for longer than a predetermined amount of time. In such an example, the control system 70 may determine that the system 2 has gone idle at step 144. If the system has gone idle, the control system 70 may turn off the tee system 2, or may turn ON a low power sleep mode to conserve power. In some examples, this may cause the distal end 14 of the rollable neck 12 to be retracted entirely within the arm 10. In other examples, this may not affect the height of the rollable neck 12 at all. Instead, the rollable neck 12 may remain at the same height until the ball is removed (e.g., via a hit), or the user turns off the system 2 (causing the rollable neck 12 to be retracted entirely within the arm 10).

On the other hand, if the ball presence data indicates that the ball has been hit off the rollable neck 12, the control system 70 may move back to step 108 where the control system 70 may select a subsequent height position for the rollable neck 12. The selected subsequent height position may be a random position within the range of the height zone selection. However, in some examples, the selected subsequent height position is different than the initial height position. This may prevent the actuation system 30 from actuating the rollable neck 12 to the same position consecutively (e.g., the distal end 14 of the rollable neck 12 may not be positioned at the same height consecutively).

Similar to that discussed above, following selection of the subsequent height position, the control system 70 may signal the actuation system 30 (using a relay signal, for example) to move the rollable neck 12 to the selected subsequent height position. If the subsequent height position is higher than the initial height position, the spool 34 may be rotated in the second direction (e.g., clockwise), causing the rollable neck 12 to progressively unwind from the spool 34, and further causing the rollable neck 12 to further extend out of the arm 10. Alternatively, if the subsequent height position is lower than the initial height position, the spool 34 may be rotated in the first direction (e.g., counterclockwise). This may cause a portion of the rollable neck 12 to be re-wound around the spool 34. As this occurs, the portion of the rollable neck 12 may transition from the hollow tube form back to the flat form, so that it can be re-wound onto the spool 34. Furthermore, as this occurs, the distal end 14 of rollable neck 12 may decrease in height to the subsequent height position.

These above described steps may continue to repeat until the user turns off the system 2 (or until the control system 70 detects that the system 2 has gone idle). When the user turns off the system 2, the control system 70 may cause the actuation system 30 to retract the distal end 14 of the rollable neck 12 entirely within the arm. Furthermore, the arm 10 may be pivoted back to the horizontal position. This may create ease of usage, set up, storage, and portability, in some examples.

Additionally, the above described steps may include various interrupts. For example, in addition to the detections discussed above, the control system 70 may also detect whether the system 2 has tipped over using tip sensors. If the control system 70 receives an indication from one or more tip sensors that the system 2 has tipped over, the control system 70 may shut off the system 2.

As another example, in addition to the detections discussed above, the control system 70 may also detect whether the user has interrupted the process. The user may interrupt the process for any reason. As a first example of this user interrupt, the user may desire to turn OFF the randomization process (or pause it). In such an example, the user may utilize the user interface 82 (e.g., the remote) to turn OFF the randomization process (or pause it). As a result of turning the randomization process OFF (or pausing it), the control system 70 may utilize a pre-stored selection of heights for the rollable neck 12. Furthermore, the control system 70 may move through these pre-stored selections in order (not randomly). Alternatively (or additionally), the user may input a desired height into the user interface 82 (e.g., 37 inches), causing the rollable neck 12 to be moved to the desired height position (e.g., 37 inches). In such an example, the user may input an exact desired height into the user interface 82 (e.g., 37 inches), or the user may request that the rollable neck 12 be moved upward or downward. For example, the user interface 82 may be a remote with "up" and "down" buttons. The user may hold the "up" button until the rollable neck 12 moves upward to a desired height. The rollable neck 12 may then remain at that height until the user changes it (e.g., by pressing "up" or "down", or turning the system 2 OFF), or until the user turns ON randomization (or unpauses it).

As another example of this user interrupt, the user may desire to move to a different height position than that selected by the control system 70. In such examples, the user may utilize a next switch included on the user interface 82. When selected, this next switch may cause the control system 70 to automatically move to step 108, where another position is selected. If randomization is still activated, the control system 70 may select another random position. If randomization is turned OFF, the control system 70 may select the next pre-stored height in the control system 70.

Figure 9:
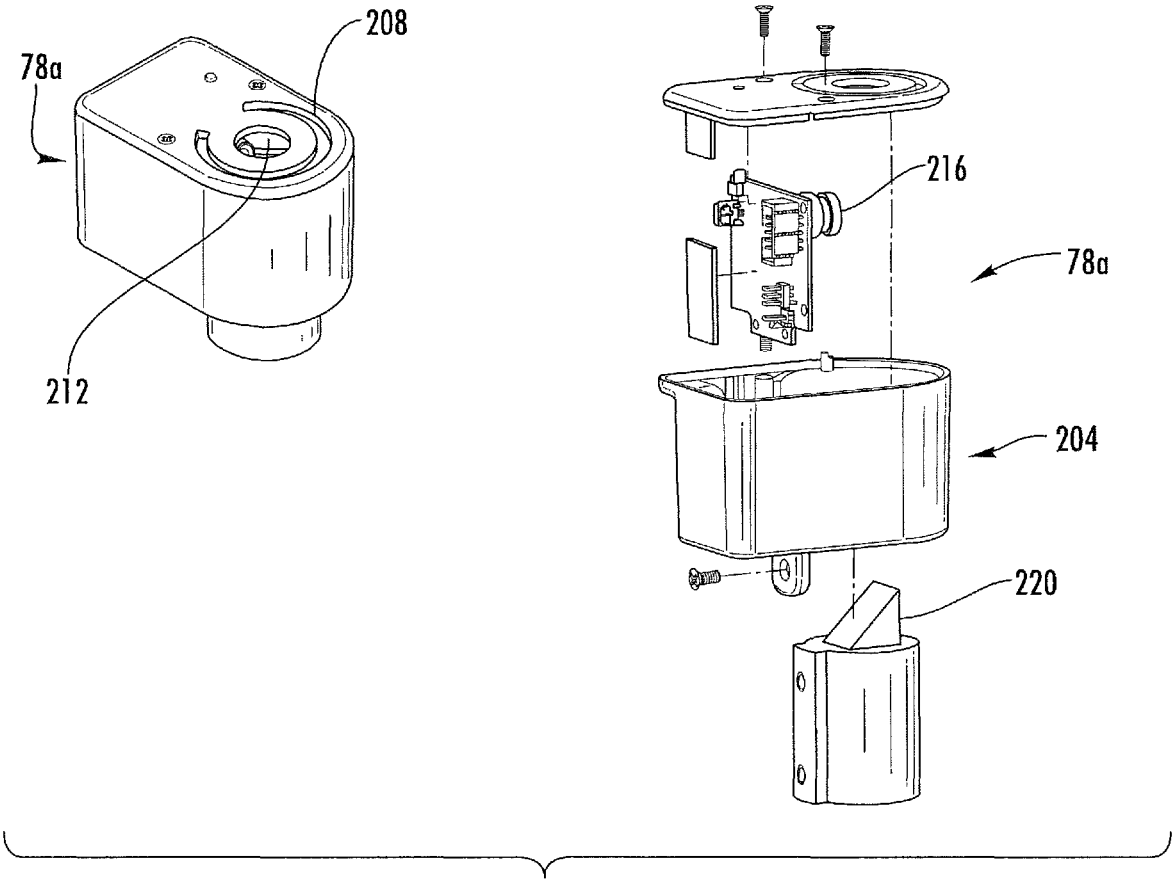
FIG. 9 illustrates an exploded view of an example ball presence sensor of the system of FIG. 1.

FIG. 9 illustrates one example of a ball presence sensor 78. As is illustrated, the ball presence sensor 78*a* of FIG. 9 includes a camera 216 that detects the presence of a ball on the distal end 14 of the rollable neck 12.

The ball presence sensor 78*a* may include an outer casing 204 that encloses the contents of the ball presence sensor 78*a*. This outer casing 204 may be attached to the end portion 11 of the arm 12. The outer casing 204 may be attached to the end portion 11 in any manner. For example, it may be attached by adhesive, it may be attached by one or more screws, it may be attached via pressure and friction (e.g., the outer casing 204 may have an internal passageway that is dimensioned to be fractionally bigger than the outer dimension of the arm 10), it may be screwed onto the end portion 11, it may be attached in any other manner, or any combination of the preceding.

The outer casing 204 may include a tube passageway 208 that allows the rollable neck 12 to pass through the interior of the outer casing 204 as the rollable neck 12 extends out of the arm 12 and moves upward along vertical axis 16. The outer casing 204 may further include a view passageway 212 that allows the camera 216 to see upward through the top of the outer casing 204. The view passageway 212 may provide the camera 216 with a view inside of the rollable neck 12, and may further provide the camera 216 with a view out of the distal end 14 of the rollable neck 12. As such, when a ball is positioned on the distal end 14 of the rollable neck 12, the camera 216 will be able to view the ball positioned on the distal end 14.

The ball presence sensor 78*a* further includes the camera 216 positioned within the outer casing 204. The camera 216 may be any type of camera that may be used to detect a ball positioned on the distal end 14 of the rollable neck 12. In some examples, the camera 216 may be able to detect the ball by detecting a color of the ball. For example, the camera 216 (and its associated programming) may be trained to detect a color of the ball (e.g., it may be trained to detect a red ball, a green ball, a white ball, or a ball having any color). As such, when a ball having the particular color (e.g., white) is positioned on the distal end 14 of the rollable neck 12, the camera 216 may detect the white color. In response to such a detection, the ball presence sensor 78*a* may generate ball presence data indicating the detected ball, and may send the ball presence data to the control system 70. Furthermore, when the ball is hit off the distal end 14 of the rollable neck 12, the camera 216 may detect that the white color is gone. In response to such a detection, the ball presence sensor 78*a* may generate ball presence data indicating the detected hitting of the ball, and may send the ball presence data to the control system 70. The control system 70 may utilize the first ball presence data and the second ball presence data to determine that the ball was positioned on the distal end 14, and then was subsequently hit off the distal end 14.

In other examples, the ball presence sensor 78*a* may only generate ball presence data when the camera 216 has detected both the ball on the distal end 14 and the ball being hit off the distal end 14. In such an example, the control system 70 may utilize this single ball presence data to determine that the ball was positioned on the distal end 14, and then was subsequently hit off the distal end 14.

The camera 216 may be positioned in any manner that allows it to view the distal end 14 of the rollable neck 12. For example, the camera 216 may be positioned to face upward towards the distal end 14. In such an example, the camera 216 may be positioned within the hollow tube form of the rollable neck 12, when the rollable neck 12 extends out of the arm 12. As another example, the camera 216 may be positioned to face horizontally (or any other direction), and a mirror 220 may be angled to reflect light waves to the camera 216 (for viewing) through the longitudinal gap of the hollow tube form of the rollable neck 12, as is illustrated in FIG. 9. In such examples, the camera 216 may view the distal end 14 (and any ball positioned on the distal end 14) through the view passageway 212.

Figure 10:
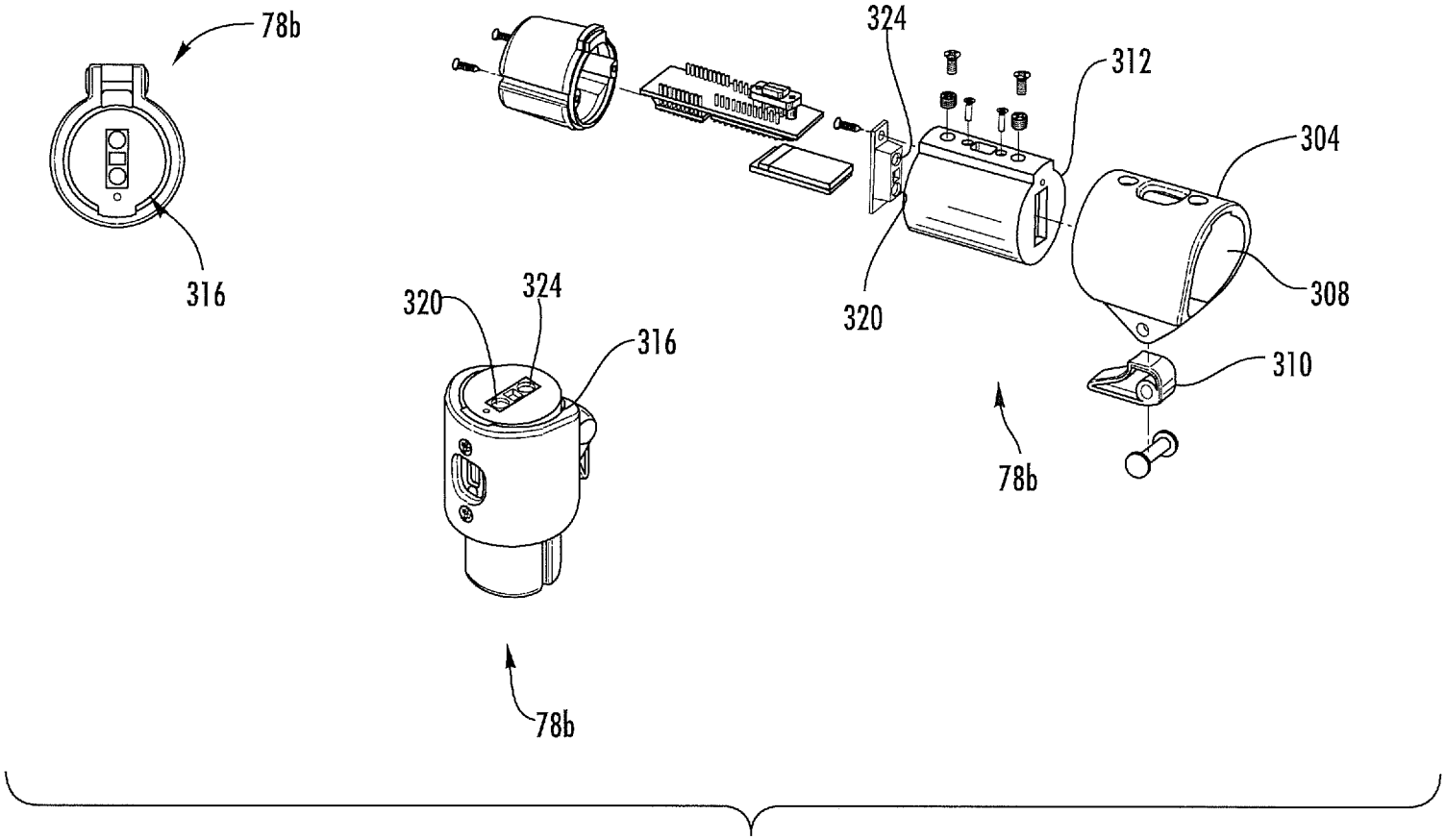
FIG. 10 illustrates an exploded view of another example ball presence sensor of the system of FIG. 1.

FIGS. 10-11 illustrates another example of a ball presence sensor 78. As is illustrated, the ball presence sensor 78*b* of FIGS. 10-11 includes a laser emitter 320 that emits a laser beam of light towards the distal end 14 of the rollable neck 12, and further includes a laser detector 324 that detects when the laser beam of light is reflected back towards the ball presence sensor 78*b* (e.g., when at least a portion of the laser beam of light is reflected back by a ball on the distal end 14).

The ball presence sensor 78*b* may include an adjustable casing 304 that attaches the ball presence sensor 78*b* to the system 2. The adjustable casing 304 may have an inner circumference 308 that may change size. This change in size of the inner circumference 308 may allow the adjustable casing 304 to be attached, detached, and reattached (repeatedly) to the system 2. For example, the adjustable casing 308 may be positioned on the end portion 11 of the arm 10, and then the size of the inner circumference 308 may be reduced, causing the adjustable casing 308 to squeeze the end portion 11 to securely attach the adjustable casing 308 to the end portion 11. Furthermore, the size of the inner circumference 308 may later be increased, causing the adjustable casing 308 to release the end portion 11 and detach from the end portion 11. This may allow the ball presence sensor 78*b* to be re-positioned on the system 2 (repeatedly).

In some examples, the ball presence sensor 78*b* may first be positioned on the end portion 11 of the arm 10, as is illustrated in FIG. 11 (which further illustrates the arm 10 in the horizontal position). Then, if the distal end 14 is extended to a high height, the ball presence sensor 78*b* may be repositioned onto the rollable neck 12, itself. This may allow the ball presence sensor 78*b* to be moved closer to the distal end 14, allowing for a more accurate detection of the ball and a more accurate detection of the hitting of the ball off of the distal end 14. When the rollable neck 12 is retracted to a lower height, the ball presence sensor 78*b* may once again be attached to the end portion 11 of the arm 10.

The size of the inner circumference 308 may be changed in any manner. As is illustrated, the ball presence sensor 78*b* includes a clasp 310. When the clasp 310 is rotated downwards, the clasp 310 may mechanically squeeze the inner circumference 308 together, causing it to reduce in size. Alternatively, when the clasp 310 is rotated upwards, the clasp 310 may mechanically release the inner circumference 308, causing it to increase in size. In other examples, a turnable knob (or any other device) may be used instead of the clasp 310.

The ball presence sensor 78*b* may further include a detection module 312 attached to the inner circumference 308 of the ball presence sensor 78*b*. Furthermore, the ball presence sensor 78*b* may also include a tube passageway 316 in-between the inner circumference 308 and the detection module 312. This may allow the rollable neck 12 to move in-between the adjustable casing 304 and the detection module 312 when the ball presence sensor 78*b* is attached to the arm 10. As such, the rollable neck 12 may extend through the ball presence sensor 78*b*, with the detection module 312 positioned within the hollow tube form of the rollable neck 12. To assist with this, the detection module 312 may be attached to the inner circumference 308 at a location that is in-line with the longitudinal gap of the hollow tube form of the rollable neck 12. This may allow the rollable neck 12 to pass through the ball presence sensor 78*b*, while still allowing the detection module 312 may be attached to the inner circumference 308.

The detection module 312 may detect a ball positioned on the distal end 14 of the rollable neck 12. The detection module 312 may detect the ball in any manner. As one example, the detection module 312 may be a laser beam distance measuring device that uses a reflected laser beam of light to measure distance. However, instead of actually measuring distance, the detection module 312 may instead utilize the reflected laser beam of light to determine that a ball is positioned on the distal end 14. As is illustrated, the detection module 312 includes a laser emitter 320 that emits a laser beam of light towards the distal end 14 of the rollable neck 12. Furthermore, the detection module 312 further includes a laser detector 324 that detects when at least a portion of the laser beam of light is reflected back towards the ball presence sensor 78*b*. In some examples, the laser beam of light may only be reflected back towards the ball presence sensor 78*b* when a ball is positioned on the distal end 14 of the rollable neck 12. As such, this reflection may be used to detect the presence of a ball.

In response to such a detection of the ball, the ball presence sensor 78*b* may generate ball presence data indicating the detected ball, and may send the ball presence data to the control system 70. Furthermore, when the ball is hit off the distal end 14 of the rollable neck 12, the laser detector 324 may no longer receive the reflected laser beam of light, thereby allowing the ball presence sensor 78*b* to detect that the ball has been hit off the distal end. In response to such a detection, the ball presence sensor 78*b* may generate ball presence data indicating the detected hitting of the ball, and may send the ball presence data to the control system 70. The control system 70 may utilize the first ball presence data and the second ball presence data to determine that the ball was positioned on the distal end 14, and then was subsequently hit off the distal end 14.

In other examples, the ball presence sensor 78*b* may only generate ball presence data when the ball presences sensor 78*b* has detected both the ball on the distal end 14 and the ball being hit off the distal end 14. In such an example, the control system 70 may utilize this single ball presence data to determine that the ball was positioned on the distal end 14, and then was subsequently hit off the distal end 14.

Figure 12:
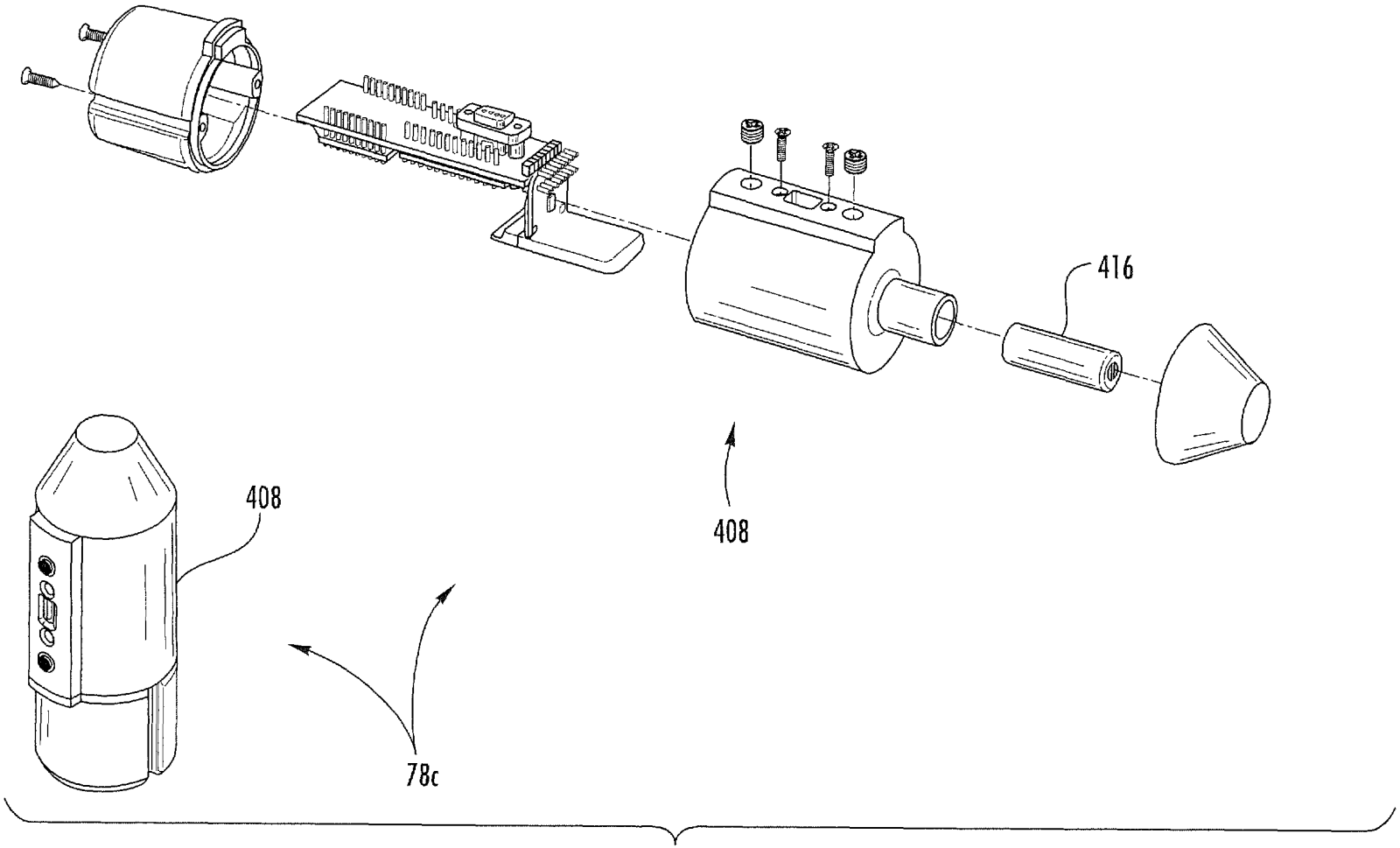
FIG. 12 illustrates an exploded view of another example ball presence sensor of the system of FIG. 1.
Figure 13:
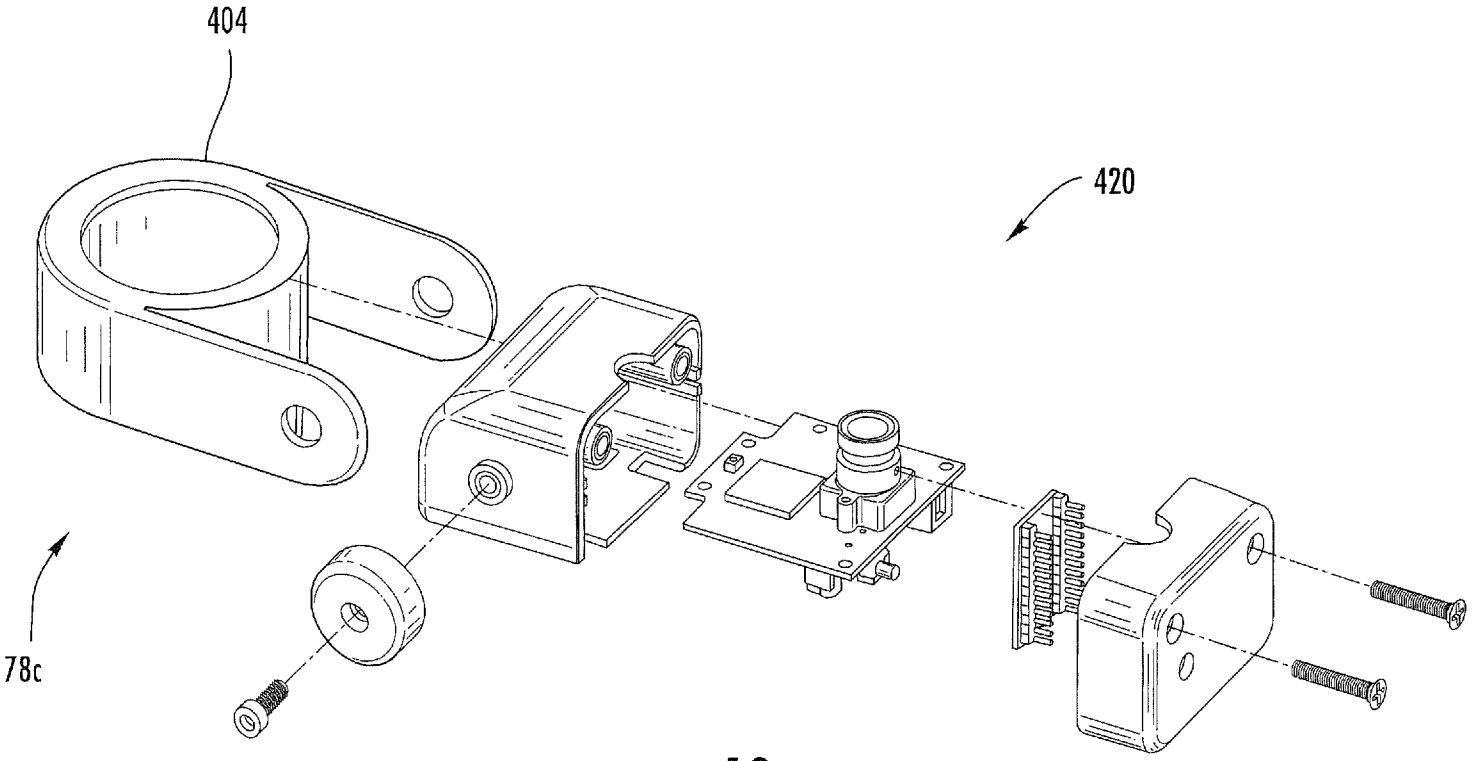
FIG. 13 illustrates an exploded view of an example bracket for the ball presence sensor of FIG. 12.
Figure 14:
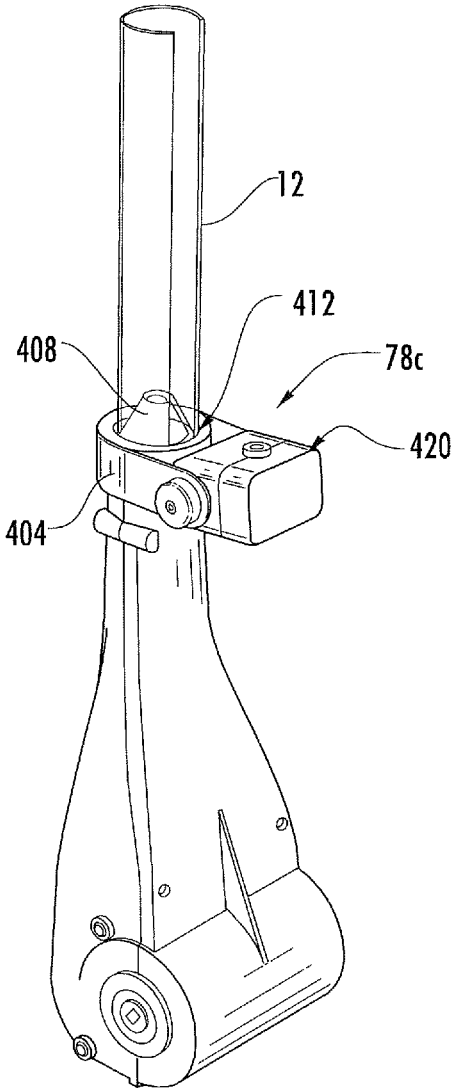
FIG. 14 illustrates a detailed view of the ball presence sensor of FIG. 12 and the bracket of FIG. 13 positioned on an arm of the system of FIG. 1, while the arm is in the vertical position.

FIGS. 12-14 illustrate another example of a ball presence sensor 78. As is illustrated, the ball presence sensor 78*c* of FIGS. 12-14 includes a laser emitter 416 that emits a laser beam of light towards the distal end 14 of the rollable neck 12, and further includes a moveable camera 420 that detects when the laser beam of light is emitted onto a ball positioned on the distal end 14.

The ball presence sensor 78*c* may include a bracket 404 (shown in FIGS. 13 and 14) that attaches the ball presence sensor 78*c* to the system 2. This bracket 404 may be attached to the end portion 11 of the arm 12. The bracket 40 may be attached to the end portion 11 in any manner. For example, it may be attached by adhesive, it may be attached by one or more screws, it may be attached via pressure and friction (e.g., the bracket 404 may have an internal passageway that is dimensioned to be fractionally bigger than the outer dimension of the arm 10), it may be screwed onto the end portion 11, it may be attached in any other manner, or any combination of the preceding.

The ball presence sensor 78*c* may also include a laser emitter module 408 (shown in FIGS. 12 and 14) that is attached to an inner circumference of the bracket 404. The laser emitter module 408 may be attached in any manner to the bracket 404. As an example, the laser emitter module 408 may be attached to the bracket 404 using one or more screws. The attachment of the laser emitter module 408 to the inner circumference of the bracket 404 may create a tube passageway 412 (shown in FIG. 14) in-between the inner circumference of the bracket 404 and the laser emitter module 408. This may allow the rollable neck 12 to move in-between the bracket 404 and the laser emitter module 408. As such, the rollable neck 12 may extend through the ball presence sensor 78*c*, with the laser emitter module 408 positioned within the hollow tube form of the rollable neck 12. In such examples, the laser emitter module 408 may be attached to the bracket 404 at a location that is in-line with the longitudinal gap of the hollow tube form of the rollable neck 12. This may allow the rollable neck 12 to pass through the ball presence sensor 78*c*, while still allowing the laser emitter module 408 to be attached to the bracket 404.

The laser emitter module 408 may include a laser emitter 416 that emits a laser beam of light towards the distal end 14 of the rollable neck 12. The laser emitter 416 may be any device that emits a laser beam or any other beam of light. In some examples, the laser emitter 416 may be a laser diode. The laser emitter 416 may emit a laser beam (or any other beam of light) having any color, size, and/or strength. As is illustrated, the laser emitter 416 is a 5 mW 650 nm red laser diode that emits a red laser beam of light.

The ball presence sensor 78*c* may further include a moveable camera 420 that detects when the laser beam of light is emitted onto a ball positioned on the distal end 14. The camera 420 may be any type of camera that can detect a beam of light emitted onto a ball positioned on the distal end 14. For example, the camera 420 (and its associated programming) may be trained to detect a color of the light beam (e.g., it may be trained to detect a red light beam, a green light beam, or a light beam having any color) emitted onto the ball. As such, when a ball is positioned on the distal end 14 of the rollable neck 12, the light beam emitted by the laser emitter 420 may be emitted onto the ball (e.g., as a red dot), and the camera 420 may detect the red dot. In response to such a detection, the ball presence sensor 78*c* may generate ball presence data indicating the detected ball, and may send the ball presence data to the control system 70. Furthermore, when the ball is hit off the distal end 14 of the rollable neck 12, the camera 420 may detect that the red dot is gone. In response to such a detection, the ball presence sensor 78*c* may generate ball presence data indicating the detected hitting of the ball, and may send the ball presence data to the control system 70. The control system 70 may utilize the first ball presence data and the second ball presence data to determine that the ball was positioned on the distal end 14, and then was subsequently hit off the distal end 14.

In other examples, the ball presence sensor 78*c* may only generate ball presence data when the camera 420 has detected both the ball on the distal end 14 and the ball being hit off the distal end 14. In such an example, the control system 70 may utilize this single ball presence data to determine that the ball was positioned on the distal end 14, and then was subsequently hit off the distal end 14.

The moveable camera 420 may be positioned in any manner that allows it to view the distal end 14 of the rollable neck 12. For example, as is illustrated in FIG. 14, the camera 420 may be positioned in-line with the longitudinal gap of the hollow tube form of the rollable neck 12. This may allow the moveable camera 420 to view inside of the rollable neck 12 so as to detect a light beam emitted onto the bottom of the ball. The moveable camera 420 may also be angled upwards toward the distal end 14 of the rollable neck 12. In some examples, as the distal end 14 of the rollable neck 12 moves upward or downward, the moveable camera 420 may also be moved so as to continue to be angled at the distal end 14 of the rollable neck 12.

In order to be moved, the moveable camera 420 may be pivotally attached to the bracket 404. This attachment may allow the moveable camera 420 to change its angle, so as to track the distal end 14 of the rollable neck 12. Movement of the camera 420 may be manual. In such an example, the user may move the camera 420. In other examples, movement of the camera 420 may be automatic. For example, the ball presence sensor 78*c* may include a motor that may move the camera 420 so as to change its angle. The motor may be controlled by the control system 70. For example, when the control system 70 receives position sensor data from the position sensors 74, the control system 70 may use this position sensor data to determine what height the distal end 14 is positioned at, and subsequently what angle the camera 420 should be moved to in order to detect a ball positioned on the distal end 14.

Modifications, additions, or omissions may be made to tee system 2 and/or the components within the tee system 2 (e.g., control system 70, actuation system 30, ball presence sensors 78) without departing from the scope of the disclosure. For example, system 2 may include any number of sensors 74 and 78. Also, any suitable logic may perform the functions of system 2 and/or the components within the tee system 2. Furthermore, one or more components of system 2 may be separated, combined, and/or eliminated.

Furthermore, although the distal end 14 of the rollable neck 12 has been described above as holding a ball positioned on it, in some examples, the distal end 14 may hold a ball holder, and the ball holder may hold the ball. The ball holder may be added to the distal end 14 once the distal end 14 is extended out of the arm 10, and may be removed from the distal end 14 before the distal end 14 is retracted back into the arm 10. The ball holder may be any type of ball holder.

This specification has been written with reference to various non-limiting and non-exhaustive examples. However, it will be recognized by persons having ordinary skill in the art that various substitutions, modifications, or combinations of any of the disclosed examples (or portions thereof) may be made within the scope of this specification. Thus, it is contemplated and understood that this specification supports additional examples not expressly set forth in this specification. Such examples may be obtained, for example, by combining, modifying, or reorganizing any of the disclosed steps, components, elements, features, aspects, characteristics, limitations, and the like, of the various non-limiting and non-exhaustive examples described in this specification. In this manner, Applicant reserves the right to amend the claims during prosecution to add features as variously described in this specification.

What is claimed is:

1. A batting tee system, comprising:

a housing;

an arm coupled to the housing and configured to move from a horizontal position to a vertical position;

an actuation system comprising:

a spool positioned within the arm and configured to rotate;

a rollable neck having a proximal end coupled to the spool and further having a distal end, wherein the rollable neck is configured to be wound around the spool when the spool rotates in a first direction and is further configured to be unwound from the spool when the spool rotates in a second direction, wherein the rollable neck is configured to have a flat form when wound around the spool and is further configured to transition from the flat form to a hollow tube form when unwound from the spool; and an actuator coupled to the spool and configured to rotate the spool in the first and second directions, wherein the actuation system is configured to extend and retract the distal end of the rollable neck out of the arm along a vertical axis, wherein, when the distal end of the rollable neck extends out of the arm along the vertical axis, the distal end is configured to hold a ball; and a control system coupled to the actuation system and configured to cause the actuation system to extend or retract the distal end of the rollable neck to a first random position out of the arm and along the vertical axis, wherein the control system is further configured to cause the actuation system to extend or retract the distal end of the rollable neck from the first random position to a second different and random position out of the arm and along the vertical axis, after the ball is hit from the distal end of the rollable neck when the distal end is in the first random position.

2. The system of claim 1, wherein the rollable neck is completely retractable into the arm.

3. The system of claim 1, wherein the arm is configured to be manually moved from the horizontal position to the vertical position.

4. The system of claim 1, wherein the arm is configured to be automatically moved from the horizontal position to the vertical position.

5. The system of claim 1, wherein the hollow tube form of the rollable neck includes a longitudinal gap extending along the length of the hollow tube form.

6. The system of claim 1, wherein the rollable neck is made from spring steel.

7. The system of claim 1, wherein the control system selects the first random position and the second different and random position using a random number generator.

8. The system of claim 1, wherein the control system randomly selects the first random position and the second different and random position from a pre-stored list of possible heights.

9. The system of claim 1, wherein the control system comprises a ball presence sensor positioned to collect ball presence data that the control system analyzes to determine if the ball has been hit from the distal end of the rollable neck.

10. The system of claim 9, wherein the ball presence sensor comprises a camera trained to detect a particular color.

11. The system of claim 10, wherein the camera is positioned to view an inside portion of the rollable neck when the distal end of the rollable neck extends out of the arm along the vertical axis.

12. The system of claim 10, wherein the ball presence sensor further comprises a mirror angled to reflect light waves to the camera through a longitudinal gap extending along the length of the hollow tube form.

13. The system of claim 9, wherein the ball presence sensor comprises a laser emitter module that includes a laser emitter configured to emit a beam of light towards the distal end of the rollable neck, wherein the laser emitter module further includes a laser detector configured to detect when at least a portion of the beam of light is reflected back towards the ball presence sensor.

14. The system of claim 13, wherein the ball presence sensor further includes an adjustable casing configured to couple the ball presence sensor to a portion of the arm or a portion of the rollable neck, wherein the adjustable casing includes an inner circumference configured to change in size.

15. The system of claim 14, wherein the laser emitter module is attached to the inner circumference of the adjustable casing, wherein the rollable neck extends in-between the laser emitter module and the inner circumference of the adjustable casing when the distal end of the rollable neck extends out of the arm along the vertical axis.

16. The system of claim 9, wherein the ball presence sensor comprises:

a bracket configured to attach the ball presence sensor to a portion of the arm;

a laser emitter module having a laser emitter configured to emit a beam of light, wherein the laser emitter module is attached to an inner circumference of the bracket; and a camera configured to detect at least a portion of the beam of light emitted onto a ball.

17. The system of claim 16, wherein the camera is pivotally coupled to the bracket and is configured to pivot in relation to the bracket to track the distal end of the rollable neck.

18. The system of claim 16, wherein the rollable neck extends in-between the laser emitter module and the inner circumference of the bracket when the distal end of the rollable neck extends out of the arm along the vertical axis.

19. A batting tee system, comprising:

a housing;

an arm coupled to the housing;

an actuation system comprising:

a spool positioned within the arm and configured to rotate;

a rollable neck having a proximal end coupled to the spool and further having a distal end, wherein the rollable neck is configured to be wound around the spool when the spool rotates in a first direction and is further configured to be unwound from the spool when the spool rotates in a second direction, wherein the rollable neck is configured to have a flat form when wound around the spool and is further configured to transition from the flat form to a hollow tube form when unwound from the spool; and an actuator coupled to the spool and configured to rotate the spool in the first and second directions, wherein the actuation system is configured to extend and retract the distal end of the rollable neck out of the arm along a vertical axis, wherein, when the distal end of the rollable neck extends out of the arm along the vertical axis, the distal end is configured to hold a ball; and a control system coupled to the actuation system and configured to cause the actuation system to extend or retract the distal end of the rollable neck.

20. The system of claim 19, wherein the control system is further configured to cause the actuation system to extend or retract the distal end of the rollable neck to a random position.

* * * * *